US005441308A

United States Patent [19]

Nishikawa

[11] Patent Number: 5,441,308

[45] Date of Patent: Aug. 15, 1995

[54] FILING DEVICE AND SUPPLEMENTAL SHEET-LIKE MATERIAL FOR THE SAME

[75] Inventor: Kenjiro Nishikawa, Osaka, Japan

[73] Assignee: Maruni Kasei Kabushikigaisha, Osaka, Japan

[21] Appl. No.: 965,410

[22] PCT Filed: Sep. 21, 1991

[86] PCT No.: PCT/JP91/01264

§ 371 Date: Dec. 30, 1992

§ 102(e) Date: Dec. 30, 1992

[87] PCT Pub. No.: WO92/17343

PCT Pub. Date: Oct. 15, 1992

[30] Foreign Application Priority Data

Mar. 29, 1991 [JP] Japan ..... 3-020111 U

[51] Int. Cl.[6] ..... B42D 3/02

[52] U.S. Cl. ..... 281/21.1; 412/901; 402/79; 281/38

[58] Field of Search ..... 281/21.1, 36, 22, 23, 281/38, 15.1, 34, 35, 37; 402/79; 412/901

[56] References Cited

U.S. PATENT DOCUMENTS

| | | | |
|---|---|---|---|
| 1,769,395 | 7/1930 | Selden | 402/79 |
| 2,277,265 | 3/1942 | Zahniser | 281/21.1 |
| 5,011,187 | 4/1991 | Hunder et al. | 412/901 X |

FOREIGN PATENT DOCUMENTS

| | | | |
|---|---|---|---|
| 2315379 | 10/1974 | Germany | 281/21.1 |
| 2451947 | 5/1976 | Germany | 281/21.1 |
| 51-11977 | 4/1976 | Japan | 412/901 |
| 55-8549 | 3/1980 | Japan | 412/901 |
| 56-46511 | 11/1981 | Japan | 412/901 |
| 62-193896 | 8/1987 | Japan | 412/901 |
| 63-161774 | 10/1988 | Japan | 412/901 |
| 63-500006 | 10/1988 | Japan | 412/901 |
| 1-153260 | 10/1989 | Japan | 412/901 |
| 2-59980 | 5/1990 | Japan | 412/901 |
| 2-117180 | 9/1990 | Japan | 412/901 |
| 6711263 | 2/1969 | Netherlands . | |
| 752615 | 7/1956 | United Kingdom | 281/21.1 |

*Primary Examiner*—Timothy V. Eley
*Assistant Examiner*—K. V. Nguyen
*Attorney, Agent, or Firm*—Wenderoth, Lind & Ponack

[57] ABSTRACT

A filing device which can detachably secure and hold sheet-like materials to be filed at the inner side of the spine with reliable adhesion without forming punching holes in which non-staining soft polyurethane elastomer having continuous high adhesion at room temperature is secured to the inner side of the spine and the sheet-like materials are secured to and held with the polyurethane elastomer at their edges, and also supplemental sheet-like materials to be used with said filing device.

9 Claims, 4 Drawing Sheets

FILING DEVICE AND SUPPLEMENTAL SHEET-LIKE MATERIAL FOR THE SAME

BACKGROUND OF THE INVENTION

1. Field of the Invention

This invention relates to a filing device comprising a front cover, a spine, and a rear cover, and by which documents, document pouches, photo-mounting sheets, postcards and all other types of sheet-like material can be detachably secured at their edges to the inner side of the spine.

2. Description of the Related Art

Known filing devices by which sheet-like materials such as documents are filed and stored include binders in which sheet-like materials having punched holes are received by binding elements or binding rings.

The above-mentioned binders retain the documents filed therein and are convenient for storage. However, they have drawbacks in that holes must be punched in each document to be filed, and that documents which cannot have holes punched therein can not be filed. In addition, since free space is required for the punched holes, documents having no such free space had to be photocopied to create such free space. Further, when documents are removed from the middle of the binder, and when they were re-inserted, the documents located in front of the documents to be removed also had to be removed and re-inserted, which makes removal and re-insertion of the documents bothersome.

A device which would not require punching holes in the documents could be realized by using adhesives or pressure-sensitive adhesives, and in fact filing devices have been proposed for securing sheet-like materials such as postcards by adhering front or rear edges or side edges thereof to the binder using adhesives or pressure-sensitive adhesives. However, once attached, these materials cannot be removed, and if they are forcibly removed, the bonded area peels off and remains on the adhesives, whereby the materials cannot be readhered or re-filed. There is also the problem that the adhesion diminishes due to a gradual hardening of the adhesive substance or to dust.

SUMMARY OF THE INVENTION

It is therefore an object of the present invention to provide a filing device by which sheet-like materials can be detachably secured at their edges to the inner side of the spine in a reliable manner without the use of punched holes, and also to provide supplemental sheet-like materials to be used with the filing device.

Another object of the present invention is to provide a filing device which does not rely on conventional adhesives or pressure-sensitive adhesives but instead employs an adhesive substance which has an adhesive property sufficient to retain sheet-like materials at their edges, which does not peel the edges of the sheet-like materials and which is not transferred to the edges of the sheet-like materials when the sheet-like materials are detached therefrom. To achieve this object the invention employs a polyurethane elastomer as the adhesive substance.

Polyurethane elastomer is very versatile. The present invention employs a soft polyurethane elastomer having continuous high adhesion at room temperature, a non-staining property which means that the adhesion is not degraded by dust because dust adhered thereto can be easily removed by wiping the dust therefrom with a wet cloth, and relative pliability.

The desired adhesive strength of the polyurethane elastomer is 450 g/cm for a 180° peeling force, and 115 g/cm for a 90° peeling force. The pliability is preferred to be less than 10° in hardness.

The adhesion of the polyurethane elastomer varies depending on the proportion of polyol and isocyanate. It is advisable to select the components and proportion thereof from reactive mixtures with excess polyol in order to obtain an adhesive property suitable for the purpose of this invention. Selection shall be made from the view points of not only adhesion, but also other factors such as non-likelihood of causing paper smears, transparency, non-yellowing, durability and so forth. In forming the polyurethane elastomer, the reaction may be accelerated by using curing agents and cross-linking agents and either a one-shot method or a pre-polymer method may be adopted.

The filing device of the invention is constructed by securing the above polyurethane elastomer to the inner side of a spine. Namely, the present invention provides a filing device comprising a front cover, a spine, a rear cover and non-staining soft polyurethane elastomer having continuous high adhesion at room temperature secured to the inner side of the spine so that sheet-like materials such as documents may be detachably secured at their edges to the spine.

In order to secure the soft polyurethane elastomer to the inner side of the spine, liquid polyurethane elastomer may be directly applied to and hardened on the inner side of the spine so that the polyurethane elastomer is secured firmly to and integrated with the inner side of the spine. Liquid polyurethane elastomer may be also applied to and hardened on a carrying sheet. In this case the carrying sheet is secured to the inner side of the spine. Further, liquid polyurethane elastomer may be formed into a sheet which is secured to the inner side of the spine as is.

When the liquid polyurethane elastomer is directly applied to and hardened on the inner side of the spine so as to be integrated therewith, it is preferred that a securing surface at the inner side of the spine be concave so that the polyurethane elastomer adhered thereto also assumes a concave shape so that the area over which the edges of the sheet-like materials are to be adhered is effectively large. An increase in the adhesive area can also be achieved if the securing surface of the spine is formed irregularly with parallel grooves extending in the lengthwise direction of the spine so that the polyurethane elastomer also assumes an irregular form. The surface on which the polyurethane elastomer is actually disposed may be either the inner surface itself of the spine or a surface of another element secured to the inner side of the spine.

The carrier for the polyurethane elastomer may be a sheet-like material selected from a group including cloth, paper, non-woven fabric, a foamed substance and plastics. Liquid polyurethane elastomer is integrated with the carrier by impregnating, coating, pouring, etc., and is hardened. Polyurethane elastomer bonds firmly to the carrier through its own adhesion. An adhesive agent may be used for adhering the carrier to the inner side of the spine, but when the carrier is impregnated with polyurethane elastomer, or when polyurethane elastomer is applied to both sides of the carrier, the carrier can be affixed through the adhesiveness of the polyurethane elastomer without using another adhesive agent. Supplementary affixing means may be adopted. For example, approximately U-shaped clasps may be used to clamp the upper and lower ends of the carrier and flat portions of said clasps are secured to the spine by means of rivets. When liquid polyurethane elastomer is directly applied to the inner side of the spine and is hardened to be integrated with the spine, supplementary affixing means are hardly needed.

Polyurethane elastomer formed into a sheet can be firmly affixed to the inner side of the spine through the strong adhesiveness of the polyurethane elastomer. Needless to say, supplementary affixing means may be adopted.

When the filing device proper is formed of a polyolefin resin such as polypropylene or polyethylene which does not adhere well to polyurethane elastomer, there is a possibility that the polyurethane elastomer sheet or the polyurethane elastomer with a carrier might peel off and drop from the spine. In this case, therefore, the surface of the inner side of the spine may be coated with metal foil, pigment foil or silk printing ink, or is surface-treated using photogravure or offset lithography, so that the polyurethane elastomer can be strongly fixed to the spine. Plastic material, such as polypropylene, constituting the spine can be processed with a corona discharge, the metal foil, pigment foil or silk printing ink can be strongly coated thereon and the surface treating by photogravure or offset lithography is also facilitated. As these surface processing materials and polyurethane elastomer strongly adhere to each other, even when a number of sheet-like materials are attached to the elastomer, the polyurethane elastomer sheet or the polyurethane elastomer with a carrier will not peel off of the spine.

A filing device having the polyurethane elastomer secured to the inner side of the spine as mentioned above can retain the sheet-like materials such as documents firmly, without the need to punch holes in the materials, by virtue of the firm adhesion between the edges of the materials and the polyurethane elastomer. Unlike the case where conventional adhesives or pressure-sensitive adhesives are used, the sheet-like materials can be easily detached from the spine as the need arises.

When liquid polyurethane elastomer is applied to the inner side of the spine and hardened thereon, the inner side can be concave or irregular (defining parallel grooves extending in the lengthwise direction of the spine), so that the exposed surface of the polyurethane elastomer will also become concave or irregular, whereby the effective area thereof is increased so that the sheet-like materials can be firmly held.

Further, when the polyurethane elastomer is carried on a sheet of cloth, paper, non-woven fabric or foamed substance, a firmness is perceived in the polyurethane elastomer and a decorative effective can be produced because the pattern or the like of the carrier can be seen. Moreover, in the case of a foamed substance, when the sheet-like material is pressed and inserted into the polyurethane elastomer until an edge thereof reaches a carrier sheet, the elasticity of the foamed substance allows good contact of the edge with the substance, so that the adhesive force is enhanced.

If a plastic sheet with a plurality of spine-like protrusions formed on its surface is used as the carrier onto which liquid polyurethane elastomer is applied and hardened, the sheet-like materials can be securely held due to both the adhesiveness of the polyurethane elastomer and friction provided by the spike-like protrusions between which the sheets are gripped. Further, if a plastic sheet with a plurality of three-dimensional protrusions in the shape of circular cones, trapezoidal circular cones, pyramids or trapezoidal pyramids arrayed in lengthwise and widthwise directions of the sheet is used to carry the polyurethane elastomer, the edge of the sheet-like material adheres to the polyurethane elastomer located between the protrusions, and portions of the sheet-like material located inwardly from the edge adhere to the polyurethane elastomer carried on the protrusions. Because adhesion occurs not only at the edge of the sheet-like material but almost at a planar surface of the material, the adhesion is extremely strong. If adjacent ones of the protrusions in the lengthwise direction of the plastic sheet are slightly offset in the widthwise direction of the sheet, a large number of protrusions will ensuredly contact the above-mentioned portions of the sheet-like material whereby the adhesiveness is quite effective.

There are no specific limits to the shape of the protrusions. However, if the base of the protrusion is made larger than the tip thereof, the protrusions will not be bent, and moreover, the above-mentioned portions of the sheet-like material will adhere to the protrusions more easily. Further, if the protrusions are of a three-dimensional shape which tapers towards the top, insertion of sheet-like materials becomes easy.

When the polyurethane elastomer sheet is directly affixed to the inner side of the spine, it is preferable to form protrusions on its surface. Such polyurethane elastomer sheet with protrusions can be easily formed by, for example, pouring liquid polyurethane elastomer in a silicon mold. In this case, it is preferable that the protrusions each have the shape of a trapezoidal pyramid or trapezoidal circular cone because the tops of the protrusions will bend if they are too small.

In addition to the above filing device wherein the sheet-like materials are inserted and held by adhesion, the present invention provides another type of filing device wherein another type of sheet-like material such as photo-mounting sheets, document pouches or the like are affixed to the polyurethane elastomer secured to the spine in advance. In this case, it is preferable that the edges of these sheet-like materials be coated with metal foil, pigment foil or silk printing ink, or surface-treated using photogravure or offset lithography, because strong adhesion is required in this type of filing device.

In addition, such a filing device is usually provided with additional sheet-like materials for supplementary use. If such additional sheet-like materials are also coated with metal foil, pigment foil or silk printing ink or surface-treated using photogravure or offset lithography on the filing edge, firm adhesion is obtained.

In either case, the polyurethane elastomer at the inner side of the spine need not cover the whole length of the spine. Various forms may be adopted, including elastomer provided at only the center of or only at both ends of the spine.

BEST MODE FOR CARRYING OUT THE INVENTION

Figure 1:
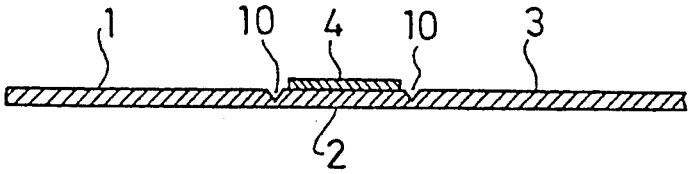
FIG. 1 is a sectional view of an embodiment of a filing device in accordance with the present invention.

FIG. 1 is a sectional view of an embodiment of a filing device in accordance with the present invention and shows a binder-type filing device comprising a front cover 1, spine 2 and rear cover 3. A polyurethane elastomer 4 secured to the inner side of the spine 2 is a soft polyurethane elastomer having continuous high adhesive strength at room temperature and which is non-staining and relatively pliable. It is desirable that the polyurethane elastomer 4 has an adhesive strength of more than 450 g/cm for a 180° peeling force and more than 115 g/cm for a 90° peeling force and a hardness of less than 10°. If the peeling force is weaker than that mentioned above, the adhesive holding strength of the sheet-like materials is inferior and when the hardness is higher than that mentioned above, the adhesive strength of the edges of the sheet-like materials becomes weak.

Figure 2:
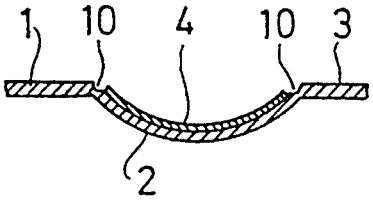
FIG. 2 is a sectional view of another embodiment in which the adhesion surface is concave.
Figure 3:
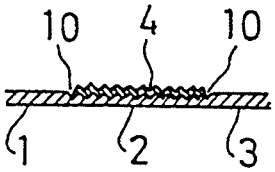
FIG. 3 is a sectional view of yet another embodiment in which the adhesion surface is made irregular.

FIGS. 2 and 3 show an embodiment in which the securing surface of the polyurethane elastomer 4 is not flat. FIG. 2 shows an embodiment with a warped surface, while FIG. 3 shows an embodiment with an irregular surface having parallel grooves extending in the lengthwise direction of the spine 2.

In these embodiment, liquid polyurethane elastomer was directly poured and hardened in a mold which was set on the securing surface of the spine. However, polyurethane elastomer may be formed into a sheet and then secured by its own adhesiveness for the embodiments of FIGS. 2 and 3.

Figure 4:
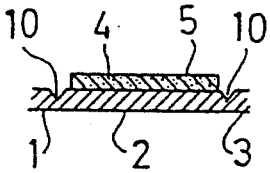
FIGS. 4 through 6 are sectional views of an embodiment in which polyurethane elastomer with a carrier is employed.
Figure 5:
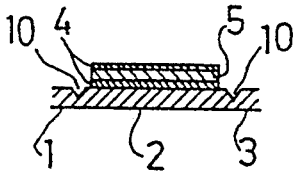
Figure 6:
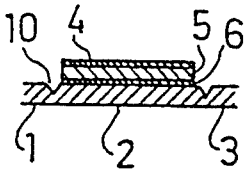

FIGS. 4 through 6 show embodiments in which polyurethane elastomer 4 is carried on a sheet-like material 5 made of cloth, paper, non-woven fabric or a foamed substance. In the embodiment of FIG. 4 the sheet-like material 5 is impregnated with the elastomer 4 and in the embodiment of FIG. 5 both sides of material 5 are coated with the elastomer 4. In either embodiment, the intrinsic adhesiveness of the polyurethane elastomer is utilized for securing the elastomer to the spine 2. FIG. 6 shows an embodiment in which the polyurethane elastomer is applied to the front surface of the sheet-like material 5 which is secured to the inner side of the spine 2 by an adhesive agent 6.

Figure 7:
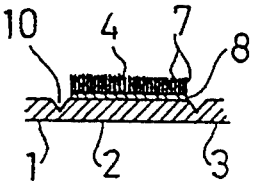
FIG. 7 is a sectional view of an embodiment in which a carrier with innumerable spike-like protrusions is employed.

FIG. 7 shows an embodiment in which the polyurethane elastomer 4 is carried by a synthetic resin sheet 8 having innumerable spike-like protrusions 7.

Figure 8:
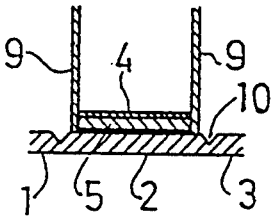
FIG. 8 is a sectional view of an embodiment in which synthetic resin sheets which work as guide for filing sheet-like materials are provided.

FIG. 8 shows an embodiment in which synthetic resin sheets 9 which work as guides for filing sheet-like materials are provided between the spine and the front and rear covers. Reference numeral 10 indicates hinges formed between the spine and the front and rear covers.

Figure 9:
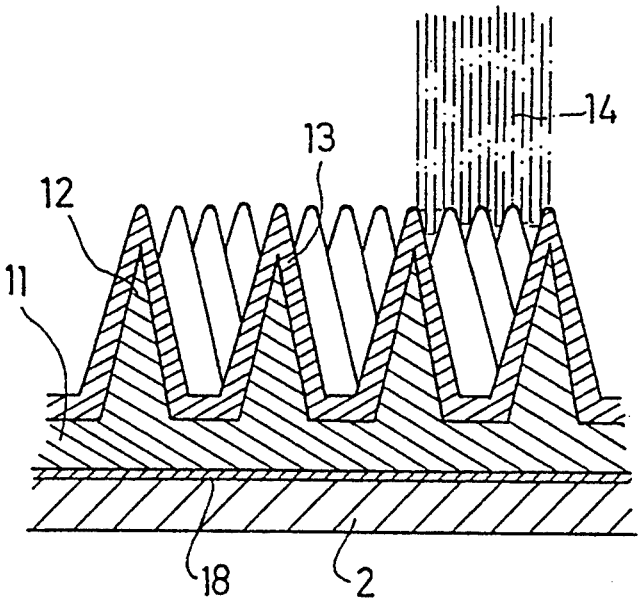
FIG. 9 is an enlarged sectional partial view of an embodiment in which a plastic sheet with protrusions is used as a carrier.
Figure 11A:
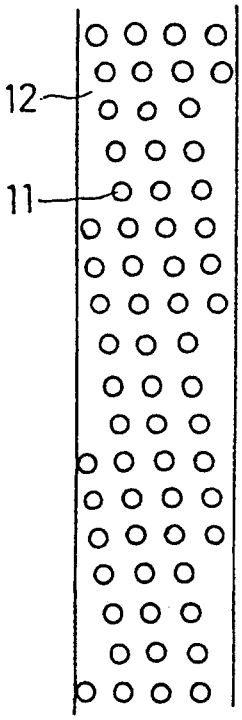
FIGS. 11(A)–11(C) are schematic plan views of representative examples of the alignment of protrusions.
Figure 11B:
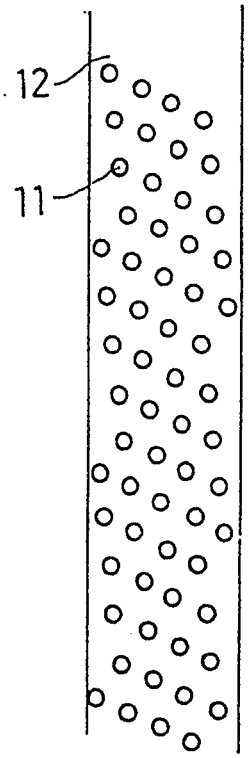
Figure 11C:
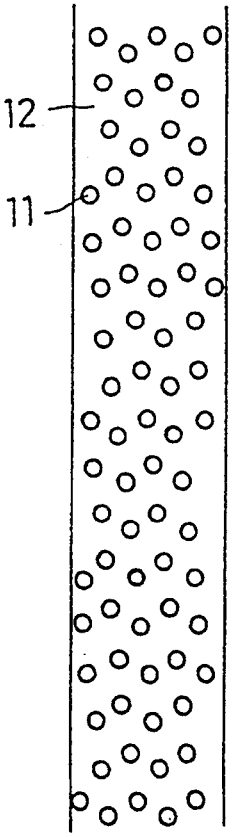

FIG. 9 shows yet another embodiment in which a plastic sheet 11 is secured to the inner side of the spine 2, and has innumerable protrusions 12 of a three-dimensional circular conical shape in the lengthwise and widthwise directions thereof. As shown in FIG. 11, adjacent protrusions 12 in the lengthwise direction of the sheet are slightly offset from being aligned in the lengthwise direction of the sheet. Namely, in FIG. 11(A), three or four protrusions 12 are aligned in the widthwise direction of the sheet, and adjacent lengthwise protrusions are slightly offset in the widthwise direction of the sheet. In FIG. 11(B), four or five protrusions 12 are aligned in a direction biased relative to the widthwise direction of the sheet, and adjacent lengthwise protrusions are also slightly offset in the widthwise direction of the sheet. In FIG. 11(C), four or five protrusions 12 arrange din a zigzag pattern in the widthwise direction and adjacent patterns in the lengthwise direction are slightly offset in the widthwise direction.

These configurations of protrusions are only examples. Any configuration may provide good adhesion so long as the adjacent protrusions in the lengthwise direction of the sheet are slightly offset in the widthwise direction of the sheet and a portion of the sheet-like material located slightly inward portion from the edge thereof contacts the protrusions when the sheet-like material is inserted therebetween.

In FIG. 9, a polyurethane elastomer 13 is carried on the protrusions of the plastic sheet 11. The polyurethane elastomer 13 is, as shown in the drawing, carried on the protrusions 12 of the plastic sheet 11 and the surface from which the protrusions extend. When the sheet-like material 14 is inserted between the protrusions 12, its edge is secured to the polyurethane elastomer between the protrusions and at the same time a portion thereof located slightly inward from the edge thereof is secured to the polyurethane elastomer carried on the protrusions. Therefore, adhesion occurs not only at the edge of the sheet-like material but also at a planar surface of the material, so that the securing of the sheet-like material to the spine is extremely strong.

Figure 10:
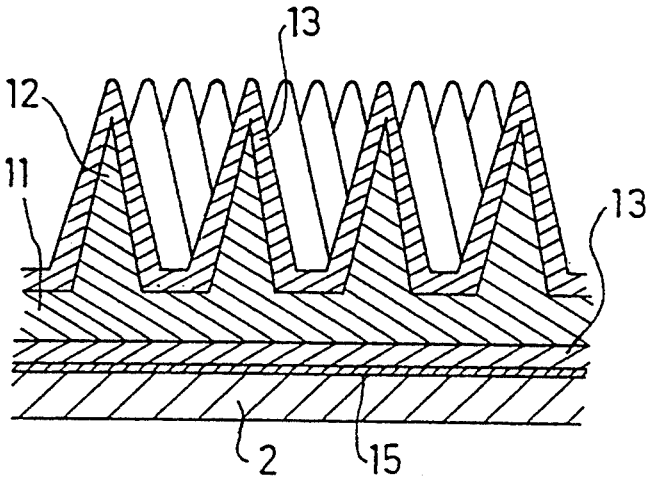
FIG. 10 is a sectional view of an embodiment similar to that of FIG. 9 but using a different manner to adhere a plastic sheet to the spine.

FIG. 10 shows another embodiment of a filing device in accordance with the present invention. Polyurethane elastomer 13 is applied not only to the front surface of plastic sheet 11 but also to its back surface, so that the plastic sheet 11 carrying the polyurethane elastomer may be secured to the inner side of the spine 2 with said polyurethane elastomer.

In this embodiment, in order to secure the plastic sheet 11 strongly, a metal (gold) foil 15 is deposited at the inner side of the plastic spine 2, and a transparent plastic sheet 11 is secured to the metal foil 15 with the polyurethane elastomer. Namely, using the property of the metal foil which strongly adheres to the spine 2 and the polyurethane elastomer, the plastic sheet 11 is strongly secured to the spine 2. In this way, even a number of sheet-like documents can be fixed to and held by the spine without the possibility of the documents coming out with the plastic sheet when the filing device is carried around. Further, as the gold foil can be seen through the transparent plastic sheet 11, the securing portion is aesthetically pleasing.

In order to secure the polyurethane elastomer to the plastic sheet, liquid polyurethane elastomer is poured in the cavity of a silicone mold having holes slightly larger than the protrusions of the plastic sheet and is hardened after the plastic sheet is set. In order to secure the polyurethane elastomer to the back surface of the plastic sheet, liquid polyurethane elastomer may be poured over the sheet again and hardened.

Figure 12:
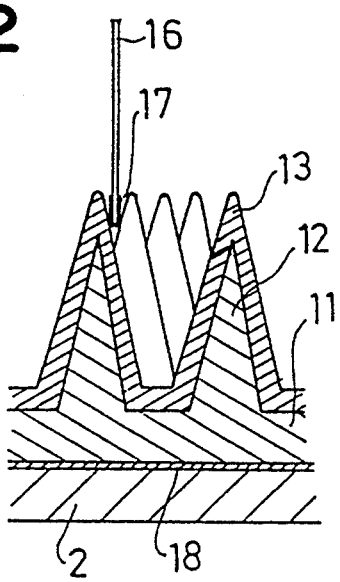
FIG. 12 is a sectional view of another embodiment of a filing device employing a plastic sheet with protrusions as a carrier.

FIG. 12 shows yet another embodiment. This embodiment is a filing device in which a sheet-like material in the shape of a document pouch 16 is secured to the polyurethane elastomer 13 of the plastic sheet 11 in advance. In this case, in order to strongly adhere pouch 16 to the polyurethane elastomer, the sheet-like material is coated with a metal foil 17 at its edge, as in the above embodiment, so that even if a number of documents are stored in the sheet-like pouch 16, there is no possibility that the pouch will come off the polyurethane elastomer. Reference numeral 18 indicates an adhesive agent.

Figure 13:
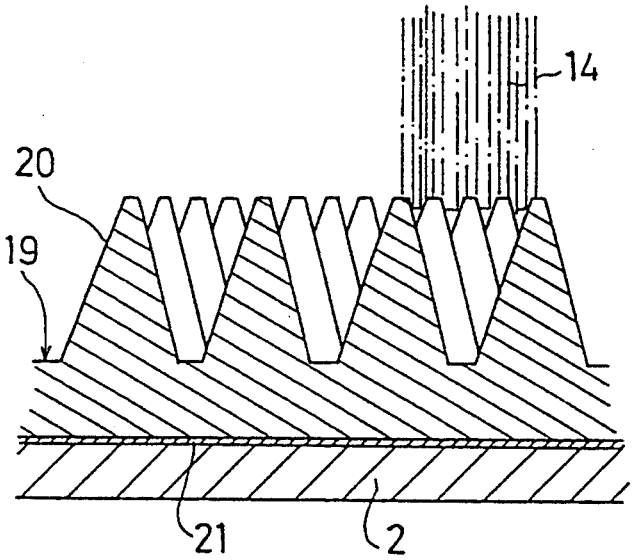
FIG. 13 is a sectional view of an embodiment employing a polyurethane elastomer sheet with protrusions.

FIG. 13 shows yet another embodiment where the polyurethane elastomer is formed into a sheet 19 and secured to the inner side of the spine 2. This polyurethane elastomer sheet 19 has innumerable protrusions 20 of a three-dimensional trapezoidal pyramidal shape in the lengthwise and widthwise direction of the sheet. As in the embodiment of FIG. 11, the innumerable protrusions 20 are so aligned that adjacent lengthwise protrusions are slightly offset from one another in the widthwise direction. The protrusions have the shape of a three-dimensional trapezoidal pyramid in order to prevent, to the extent possible, bending of the tops thereof. Various other shapes may be adopted, including trapezoidal circular cones. This polyurethane elastomer sheet 19 is formed by pouring liquid polyurethane elastomer into a silicone mold. In this case as well, when sheet-like materials 14 are inserted between protrusions 20, the sheet edge is secured to the polyurethane elastomer between the protrusions and at the same time the portions slightly inward from the edge thereof are also secured to the protrusions. Therefore, adhesion occurs not only at the edge of the sheet-like material but also almost at a planar surface of the material, so that the securing of the material to the spine is extremely strong. Reference numeral 21 indicates metal foil deposited onto the inner side of the plastic spine 2.

The above embodiments are only examples of filing devices according to the invention, which naturally is not limited to these embodiments but encompasses various changes and modifications within the scope of the appended claims.

I claim:

1. A filing device comprising a front cover, a rear cover, a spine connecting the front and rear covers, and non-staining soft polyurethane elastomer secured to said spine at an inner side of the spine, said polyurethane elastomer having continuous high adhesion at room temperature, and said polyurethane elastomer having an exposed surface at the inner side of the spine defining parallel grooves extending in the lengthwise direction of the spine, whereby sheets of materials are detachably securable at their edges to the spine via said elastomer.

2. A filing device comprising a front cover, a rear cover, a spine connecting the front and rear covers, a non-staining soft polyurethane elastomer having continuous high adhesion at room temperature, and a plastic sheet carrying said elastomer and securing said elastomer to the spine at an inner side of the spine, said plastic sheet having plurality of protrusions arrayed in lengthwise and widthwise directions of the sheet.

3. A filing device as claimed in claim 2, wherein said spine is plastic, and further comprising a layer of polyurethane elastomer affixed to a back surface of the plastic sheet, and a surface material affixed to said spine, said surface material being a material selected from the group consisting of a metal foil, a pigment foil and a silk printing ink, the back surface of said plastic sheet being secured to an inner surface of the spine via said layer of polyurethane elastomer and said surface material.

4. A filing device as claimed in claim 2, wherein said spine is plastic, and further comprising a layer of polyurethane elastomer affixed to a back surface and the plastic sheet, and print on said spine, the back surface of said plastic sheet being secured to an inner surface of the spine via said layer of polyurethane elastomer and said print.

5. A filing device claimed in claim 3, wherein the plastic sheet is transparent or semi-transparent.

6. A filing device claimed in claim 4, wherein the plastic sheet is transparent or semi-transparent.

7. A filing device comprising a front cover, a rear cover, a spine connecting the front and rear covers, and a sheet of non-staining soft polyurethane elastomer secured to said spine at an inner side of the spine, said polyurethane elastomer having continuous high adhesion at room temperature and a plurality of protrusions arrayed in lengthwise and widthwise directions of the sheet.

8. A filing device as claimed in claim 7, wherein said spine is plastic, and further comprising a surface material affixed to said spine, said surface material being a material selected from the group consisting of a metal foil, a pigment foil and a silk printing ink, said sheet of polyurethane elastomer being secured to the inner surface of the spine via said surface material.

9. A filing device as claimed in claim 7, wherein said spine is plastic and further comprising print on said spine, said carrier being secured to the spine via said print.

* * * * *